United States Patent [19]

Meyer

[11] Patent Number: 5,014,667

[45] Date of Patent: May 14, 1991

[54] ELECTRO-HYDRAULIC CONTROL SYSTEM FOR GOVERNORS

[75] Inventor: Hal G. Meyer, Rockford, Ill.

[73] Assignee: Precision Governors, Inc., Rockford, Ill.

[21] Appl. No.: 562,816

[22] Filed: Aug. 6, 1990

[51] Int. Cl.[5] ..... F02D 9/10; F02D 11/10

[52] U.S. Cl. ..... 123/360; 123/361; 123/399; 123/401; 123/385; 251/129.03

[58] Field of Search ..... 123/90.11, 90.12, 352, 123/360, 361, 376, 385, 399, 401; 60/39.25; 91/42; 251/129.03, 129.22; 361/152

[56] References Cited

U.S. PATENT DOCUMENTS

| | | | |
|---|---|---|---|
| 3,596,643 | 8/1971 | Schweitzer | 123/360 X |
| 3,963,091 | 6/1976 | Noddings et al. | 123/360 X |
| 3,978,837 | 9/1976 | Lundberg | 123/360 X |
| 4,164,722 | 8/1979 | Garvey | 335/272 |
| 4,253,603 | 3/1981 | Johnson | 236/86 |
| 4,275,691 | 6/1981 | Wolff et al. | 123/385 X |
| 4,458,713 | 7/1984 | Wernberg | 137/117 |
| 4,510,905 | 4/1985 | Leiber | 123/360 |
| 4,515,126 | 5/1985 | Kessler | 123/401 |
| 4,542,802 | 9/1985 | Garvey et al. | 180/306 |
| 4,546,744 | 10/1985 | Bonfiglioli | 123/360 X |
| 4,709,619 | 12/1987 | Bartholomaus et al. | 251/129.03 X |
| 4,716,723 | 1/1988 | Ralston et al. | 60/39.281 |
| 4,785,778 | 11/1988 | Gibson et al. | 123/385 X |
| 4,794,544 | 12/1988 | Albright et al. | 364/494 |
| 4,903,936 | 2/1990 | Kajiwara | 251/129.03 X |
| 4,911,121 | 3/1990 | Barnes | 123/385 X |
| 4,913,032 | 4/1990 | Wernberg | 91/361 |

*Primary Examiner*—Willis R. Wolfe

*Attorney, Agent, or Firm*—Rockey and Rifkin

[57] ABSTRACT

The governor of the invention consists of an output solenoid having a plunger operatively connected to the mechanism to be controlled. The output solenoid is a "bang-bang" type such that full power or no power is delivered to the solenoid even for small errors between the desired operating condition and actual condition of the mechanism to be controlled. The output solenoid is connected in a hydraulic circuit with a control solenoid having a control valve such that the movement of the fluid through this circuit is regulated by the control solenoid. The control solenoid is of the proportional type such that the control valve's position is directly related to the difference between the actual operating condition and the desired operating condition of the mechanism to be controlled. A position sensor is provided on the output plunger to provide feedback to the controller such that as the output plunger approaches the desired position the control valve will gradually begin to close to thereby decrease the speed of movement of the output plunger to avoid overshoot of the desired position. Once the output plunger is in the desired position and the control valve is closed the output plunger is locked in position such that the power delivered to the coil of the output solenoid can be maintained at an intermediate level.

18 Claims, 4 Drawing Sheets

POWER TO CONTROL SOLENOID
CONTROLLER
POWER TO OUTPUT SOLENOID
ENGINE SPEED
CONTROL VALVE
1
2
3
5
7
9
11
12
13
14
15
17
19
20
21
22
23
25
29
31
32
33
35
40

ELECTRO-HYDRAULIC CONTROL SYSTEM FOR GOVERNORS

BACKGROUND OF THE INVENTION

The invention relates, generally, to governors and, more particularly, to an electro-hydraulic control system therefor.

The typical electronic governor acts as a feedback device on a machine or engine that is used to provide automatic control of an operating condition, for example, speed, pressure, or temperature. One common use of such governors is to automatically position the throttle of an engine to control the engine's speed.

The typical electronic governor includes of a solenoid having a plunger movable to an infinite number of positions over a pre-determined range as shown in U.S. Pat. No. 3,883,839. The plunger is connected to the machine or mechanism to be controlled such that movement of the plunger performs a controlling operation on the machine or mechanism. A coil is wound around the plunger such that when an electric current is passed through the coil the electromagnetic force will move the plunger in a first direction. A return spring is arranged in the solenoid that opposes the movement of the plunger in the first direction. By properly selecting the spring constant and by varying the current delivered to the coil, the plunger can be continuously repositioned in response to an error signal that represents the difference between the desired operating condition and actual operating condition.

The typical solenoid actuator is of a proportional variety such that the speed and distance of the plunger's movement are directly related to the magnitude of the error signal such as those shown in U.S. Pat. Nos. 3,883,839, 4,855,702, 4,321,571 and 4,164,722. In other words, when the error signal is large the plunger will move more quickly and when the error signal is small the plunger will move more slowly. In proportional solenoids, to provide a stable movement of the plunger, the spring force must intersect increasing values of current. As a result, the typical proportional governor is not very efficient because only the middle range of available force will provide useful work as will be understood by one of ordinary skill in the art.

Because the position of the plunger in the typical solenoid actuator is controlled solely by the electromagnetic force developed by the coil and the opposing force generated by the return spring, the position of the plunger can be unintentionally changed due to external forces exerted on the governor such as those caused by vibration of the machine to be controlled. In other words, the combined forces of the spring and coil do not lock the plunger in a stationary position. Rather, the typical electronic governor has some "softness" such that undesired variations in the plunger's position can result. This "softness" adversely affects the precision with which the plunger can be positioned. Moreover, conventional proportional electronic governors require an integrator build u to generate high output power even for small errors. This build up requires time and often results in overshoot or instability of the plunger.

Finally, in order for the prior art solenoids to maintain the plunger's desired position near high output conditions, relatively high current must be constantly provided to the coil to balance the force generated by the compression spring. As a result, the prior art devices continuously draw relatively high current, even when the solenoid is at an equilibrium position.

The typical hydraulic governor avoids these undesirable and unintentional changes in the plunger's position by using hydraulic fluid to move the plunger and hold it in the desired position. While these hydraulic systems avoid the "softness" of the electronic systems, they utilize complex and expensive hydraulic pumps and mechanical stabilizing mechanisms including various arrangements of pistons, linkages, springs, reservoirs and filters. As a result, these hydraulic systems are expensive to manufacture and maintain and are difficult to install.

Thus, an electro-hydraulic control for a governor that eliminates the need for proportional output solenoids, hydraulic pumping systems, mechanical stabilizing mechanisms, and high power drain is desired.

OBJECTS OF THE INVENTION

It is a general object of the invention to provide an improved electro-hydraulic governor.

It is another object of the invention to provide an electro-hydraulic governor in which the hydraulic fluid is moved through the system by an electronic actuator.

It is a further object of the invention to provide an electro-hydraulic governor in which the output solenoid is locked into its equilibrium position such that forces generated by the external environment will not affect its position.

It is yet another object of the invention to provide an electro-hydraulic governor which utilizes a hydraulic circuit to control movement of the output solenoid.

It is a still further object of the invention to provide an electro-hydraulic governor in which the output solenoid can be operated at full power or no power even for small deviations in the condition to be controlled.

It is a further object of the invention to provide an improved electro-hydraulic governor in which the power to the solenoid can be maintained at a relatively low level when the solenoid is in its equilibrium or stable position.

Other objects of the invention, in addition to those set forth above, will become apparent to one of ordinary skill in the art from the following detailed description of the invention.

SUMMARY OF THE INVENTION

The governor of the invention consists of an output solenoid having an output plunger operatively connected to the mechanism to be controlled. A coil surrounds the output plunger such that when current is delivered to the coil, the output plunger will tend to move in a first direction. A return spring creates a force on the plunger which opposes the movement generated by the coil. The output solenoid is a "bang-bang" type such that either full power or no power is delivered to the coil even for small deviations between the desired operating condition and the actual operating condition, for example, the operating condition can be engine speed. A closed hydraulic control system is used to regulate the movement of the output plunger.

The output solenoid is arranged in a fluid circuit such that the output plunger is free to move only when fluid in the circuit is also free to move. The movement of the fluid through this circuit is controlled by a separate control solenoid having a control valve for regulating flow of fluid through the circuit. The control solenoid is of the proportional type such that the control valve's position is directly related to the difference between the actual operating condition and the desired operating condition. As a result, if the output plunger is only required to move a small distance, the control valve will only be open slightly such that the movement of the plunger of the output solenoid is very slow. If the output plunger is required to move a great distance the control valve is opened full such that the speed of movement of the output plunger is great. Once the output plunger reaches the desired position, the control valve is closed such that fluid cannot flow through the system. Thus, the output plunger is effectively locked in position when the difference between the actual condition and desired condition is negligible.

A position sensor is provided on the output plunger to provide feedback to the controller for the control solenoid such that as the output plunger approaches the desired position, the control valve will gradually begin to close to thereby decrease the speed of movement of the output plunger to avoid overshoot of the desired position. Once the output plunger is in the desired position and the control valve is closed the output plunger is locked in position and the power delivered to the coil of the output solenoid is returned to an intermediate level.

DETAILED DESCRIPTION OF THE INVENTION

Figure 1:
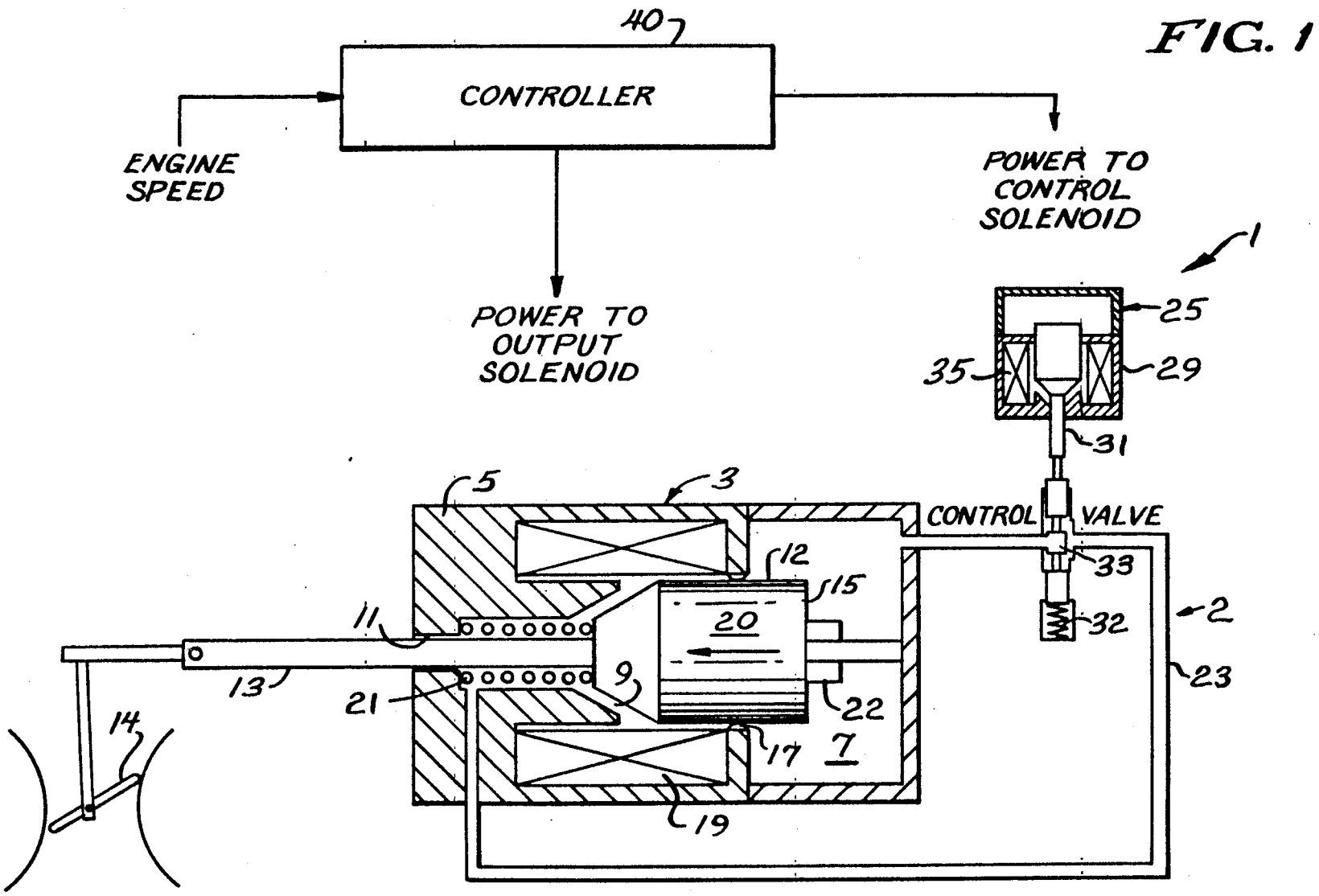
FIG. 1 shows a schematic section view of a preferred embodiment of the governor of the invention.

Referring more particularly to FIG. 1, the governor of the invention 1 includes an actuator 2 consisting of an output solenoid 3 having a housing 5 formed with a first chamber 7 and a second chamber 9. An output plunger 12 is mounted in bearings 11 such that it can reciprocate along its longitudinal axis relative to the housing 5. The output plunger has a rod portion 13 integrally formed with a body portion 15. The body portion 15 of the output plunger is supported in a seal 17 such that the first chamber 7 and second chamber 9 are isolated from one another. The rod portion 13 extends beyond the housing and is connected to a suitable mechanism which the governor is to control. In the illustrated embodiment, output plunger 12 is connected to the valve 14 of a carburetor such that the delivery of fuel to an engine (not shown) can be controlled by the governor.

A coil 19 surrounds the output plunger 12 such that when current is delivered to the coil 19 the output plunger 12 will be moved in the direction of arrow 20 along its longitudinal axis under an electromagnetic force. A return spring 21 is disposed coaxially over the rod portion of the output plunger 12 such that it provides an opposing force to the electromagnetic force created by the coil 19.

The output solenoid 3 is of the "bang-bang" type. A "bang-bang" solenoid is one where full power is delivered to the coil 19 to turn the solenoid on full and move the plunger in a first direction, the direction indicated by arrow 20, and no power is delivered to the coil to turn the solenoid off such that the return spring 21 can move the plunger in a second direction opposite to the first direction. When the plunger is in an at rest or equilibrium position the power delivered to the coil is at an intermediate level. As a result, "bang-bang" solenoids do not require time for an integrator build up as is the case with a conventional, proportional governors such that overshoot is greatly reduced.

Figure 4A:
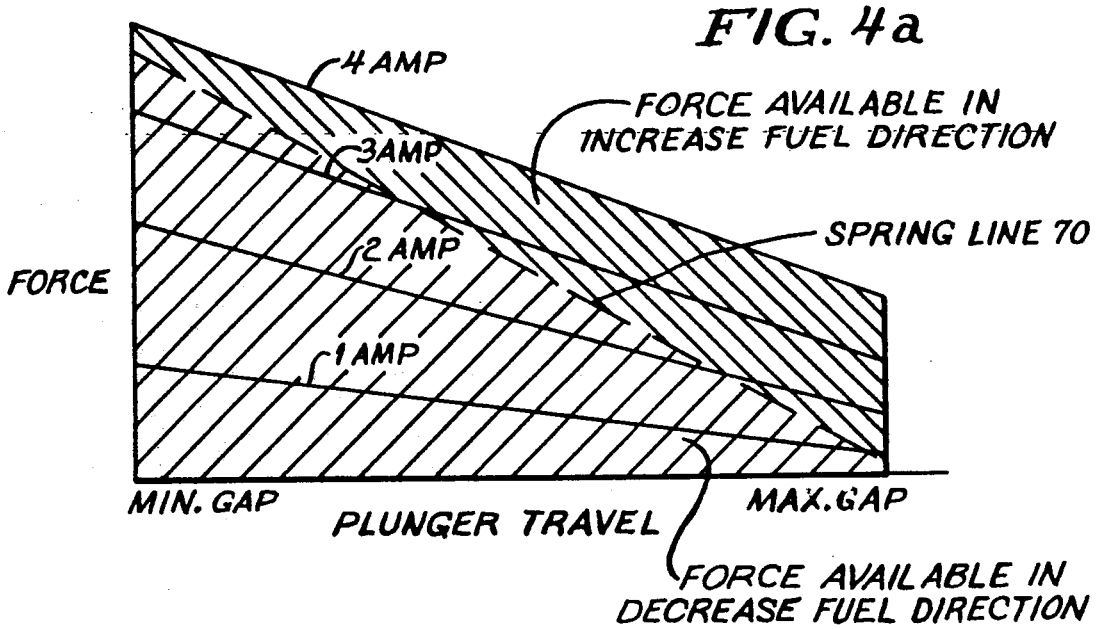
FIGS. 4*a* and 4*b* are graphs showing the available work output for a typical electronic governor.
Figure 4B:
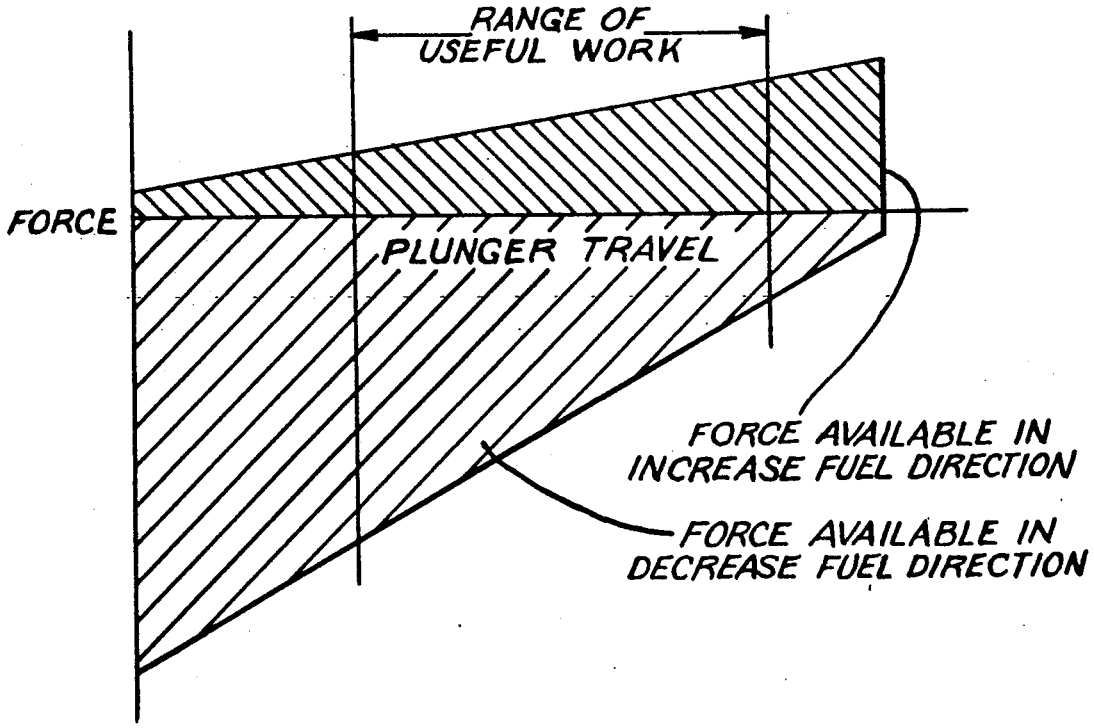

Moreover "bang-bang" solenoids are more efficient than proportional solenoids in that they have a wider range of useful work. Referring more particularly to FIGS. 4*a* and 4*b*, these graphs show the characteristics of a proportional solenoid. The graph of FIG. 4*a* plots the distance of plunger travel against force where stable proportional motion is produced. The spring line 70 must intersect increasing values of current as the force exerted by the spring rises. The cross-hatched area above the spring line 70 shows the force available in a first direction and the cross-hatched area below spring line 70 shows the force available in a second direction.

The graph of FIG. 4*b* shows distance of plunger travel plotted against force where the x-axis is the spring line 70 from the graph of FIG. 4*a*. Thus, the cross-hatched area above the x-axis represents the force available in a first direction and the cross-hatched area below the x-axis represents the force available in a second direction. As is evident from FIG. 4*b*, the available force is not symmetrical. Moreover, the force available in the first direction gets very low near the minimum gap, while the force available in the second direction gets very low near the maximum gap. As a result, only the middle range of travel of the plunger can provide useful work.

Figure 5A:
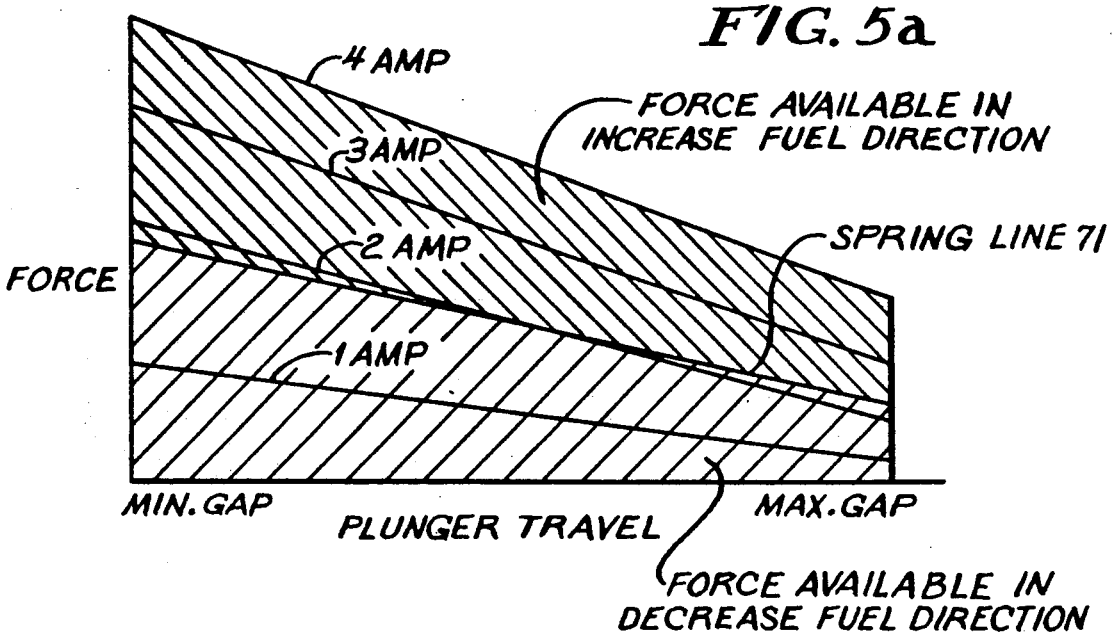
FIGS. 5*a* and 5*b* are graphs showing the available work output for the governor of the invention.
Figure 5B:
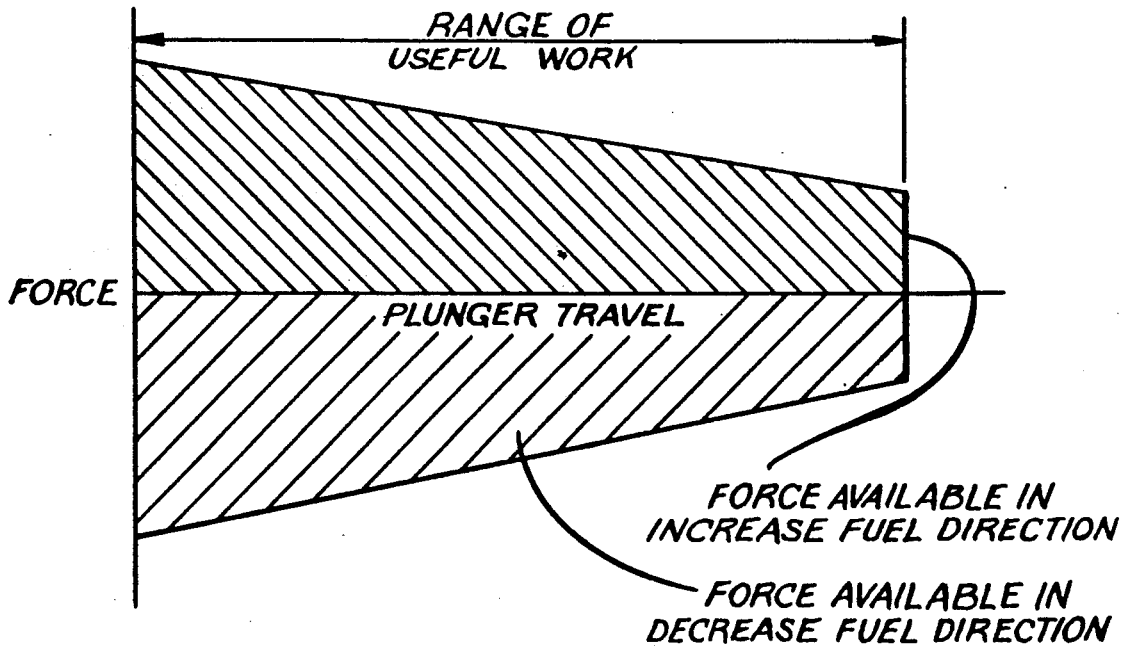

FIGS. 5*a* and 5*b* show graphs similar to those of FIGS. 4*a* and 4*b* for the characteristics of the present invention. Because stability of the governor of the invention is provided by the controller 40 and control solenoid 25, the "bang-bang" output solenoid 2 may be used. With a "bang-bang" solenoid the spring force need not intersect increasing values of current but can intersect decreasing values as shown in FIG. 5*a*. Preferably, the spring line 71 intersects at 1.8 amps at the minimum gap and 2.2 amps at the maximum gap. As a result, the forces in the first and second directions are symmetrical and do not become small at either the minimum or maximum gap as shown in FIG. 5*b*. Thus, with the electro-hydraulic system of the invention the entire range of travel of the plunger can provide useful work such that a much more efficient governor results.

A position sensor 22, preferably a linear variable differential transformer (LVDT) or a rotary variable differential transformer (RVDT) although any suitable potentiometer or position sensor maybe used, is provided to produce a signal indicating the position of output plunger 12. The signal is used by the controller 40, as will hereinafter be described, to provide a function known as temporary droop which provides stability to the output plunger 12. As the output plunger 12 moves toward the desired position, the feedback from the position sensor 22 is used to slow the movement of the output plunger as it approaches its final position, thereby to gently ease it into its final position. The principal of temporary droop is well known in the field of hydraulic governing where it has been generally accomplished by mechanical means.

A conduit 23 is disposed between the first chamber 7 and the second chamber 9 such that the chambers are in communication with one another to permit transfer of hydraulic fluid. A control solenoid 25 is disposed in circuit with conduit 23 to regulate the rate of flow of fluid between the two chambers. Because output plunger 12 can only move when the fluid in the system is free to flow between the first and second chambers, the operation of the control solenoid 25 can regulate speed of movement of the output plunger 12 and lock it in a desired position.

The control solenoid 25 consists of a housing 29 in which a control plunger 31 can be supported for either rotary or linear reciprocal motion. A coil 35 can be energized to create an electromagnetic force which moves the control plunger 31 in a first direction and a return spring 32 is arranged to oppose the movement of the control plunger generated by the electromagnetic force of the coil. By varying the current supplied to the coil 35 the control plunger 31 can be moved in either direction or held in a stationary position. The control solenoid 25 is a proportional solenoid where the movement of the plunger is proportional to the current delivered to the coil and is directly related to the difference between the desired operating condition and the actual operating condition.

Control Plunger 31 supports a control valve 33 which cooperates with conduit 23 to regulate the flow of fluid between the first and second chambers. When the control valve 33 is located in its centered position fluid flow between the chambers is prevented, locking output plunger 12. If the control valve 33 is slightly open, the output plunger 12 can only move slowly because the flow of fluid is restricted. Conversely when the control valve 33 is fully open the output plunger 12 can move rapidly. Thus, the movement of the output plunger 12 is regulated by the position of the control valve 33 o control solenoid 25.

Figure 2:
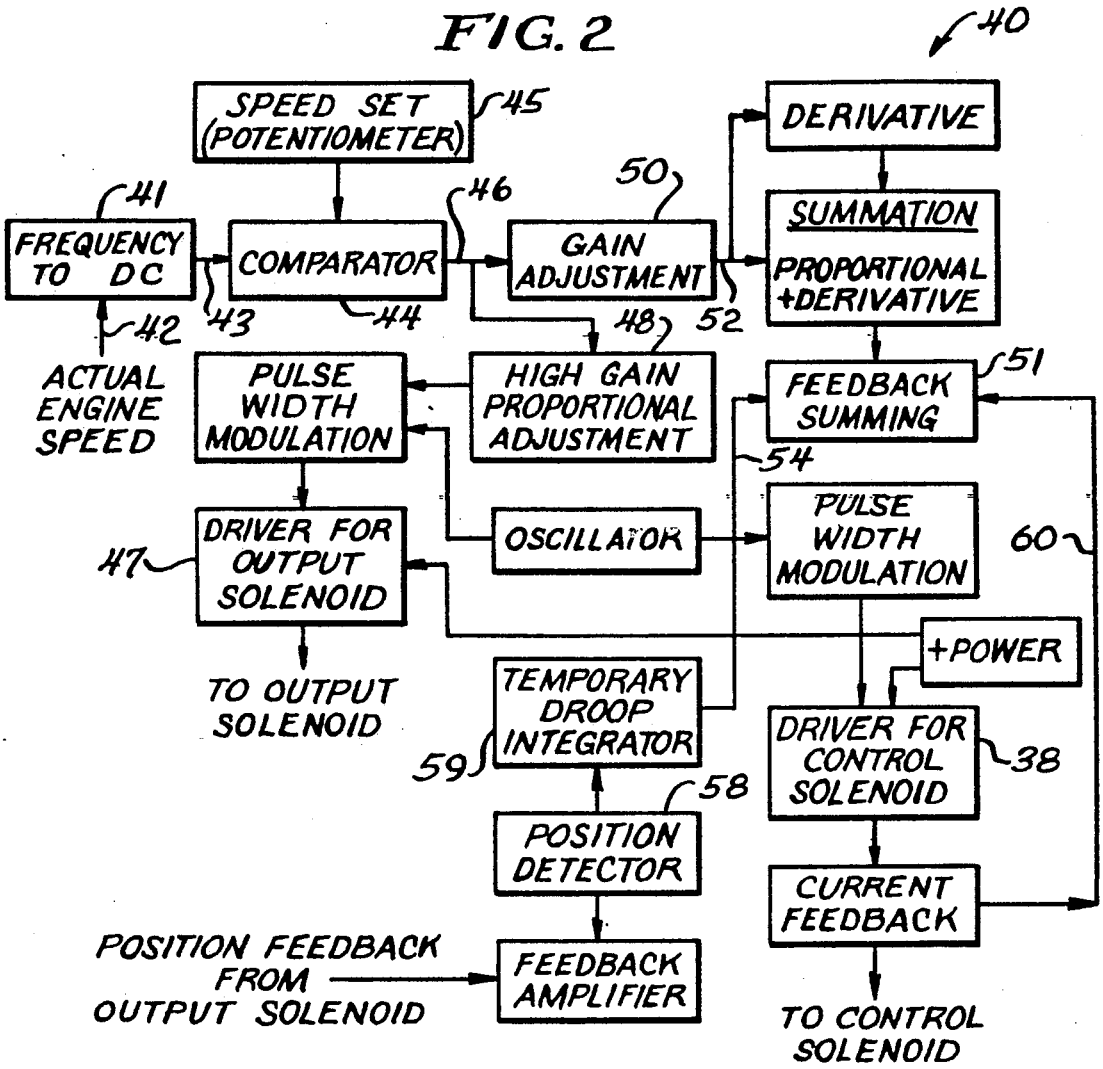
FIG. 2 shows a block diagram of the controller of the invention.

The operation of the governor is controlled by controller 40, shown in detail in FIG. 2. Controller 40 includes a convertor 41 for receiving a pulse input signal 42 which represents the actual operating condition regulated by the governor. For example, in the illustrated embodiment the input signal 42 will represent the actual engine speed, typically in the form of ignition pulses or pulses from a magnetic pickup or other similar device. The convertor converts this pulse signal into a D.C. signal 43 which is delivered to the comparator 44. Comparator 44 also receives a D.C. signal from the potentiometer 45 which represents the value of the desired operating condition, for example, throttle speed. The comparator 44 sums these two signals to produce a proportional signal 46 representing the error between the actual and desired operating conditions. Error signal 46 is given high gain by amplifier 48, pulse width modulated and delivered to the driver 47 for the output solenoid 3. Preferably, driver 47 is a Darlington transistor. Receipt of the high gain signal from the driver 47 turns the output solenoid 3 either full on or off if the desired condition is greater or less than the actual condition, respectively, or to an intermediate current if the desired condition and actual condition are substantially the same. However, until the control solenoid 25 allows fluid to flow between the first and second chambers, the output plunger 12 will not be able to move even though it is turned full on or off.

To open control valve 33 the error signal is also given a low gain adjustment by amplifier 50. The amplified proportional signal 52 can be summed with its derivative signal before being delivered to the feedback summing block 51. It will be appreciated by one of ordinary skill in the art that the proportional signal indicates the size of error signal 46 and the derivative signal indicates the rate of change of the error signal 46.

The feedback summing block 51 also receives a current feedback signal 60 which is employed to turn the driver 38 on full until current begins to flow into coil 35 at which time the proportional signal will take over. The feedback summing block 51 receives a third signal 54 to provide the function of temporary droop. Signal 54 is created by position detector 58 upon input from the position sensor 22. Basically, position detector 58 provides a signal to the feedback summing block 51 that indicates that the movement of the control plunger 31 should stop a predetermined distance short of the desired position indicated by the error signal 46. The temporary droop integrator 59 then continuously integrates the value representing the predetermined distance until it reaches zero such that the undershoot created by the position detector gradually reaches zero. In this manner the control plunger 31 is eased into its final position.

The summed signal from the feedback summing block 52 is modulated and delivered to the driver for the control solenoid 38. The driver 38 is preferably a Darlington transistor. The driver 38 delivers current to coil 35 such that the control value 33 can be positioned as desired.

To describe the operation of the governor, assume that initially the actual engine speed is equal to the desired engine speed such that the output solenoid 3 is in an equilibrium position. In this position the error signal 46 is zero such that both the control solenoid and the output solenoid are at rest and the output plunger 12 is locked in position. If, however, the actual engine speed should drop below the desired speed because a load is placed on the engine or if the desired speed is raised above that of the actual speed, an error signal 46 will be generated by the comparator 44. After being amplified the high gain signal is delivered to the output solenoid 3 where, because it is of a "bang-bang" design, it will be turned on full to move in the direction indicated by arrow 20 in FIG. 1 or will be turned off to move under force of return spring 21 in the opposite direction. However, even though the output solenoid 3 is turned either on full or off it will be unable to move until the control valve 33 of the control solenoid 25 is opened.

Virtually simultaneously with the turning on or off of the output solenoid, the control solenoid 25 will receive a signal from driver 38 indicative of the error between the desired and actual condition. In response to this signal, the control valve 33 will be opened a distance proportional to the error between the two signals. In other words, where the error is great the valve will be opened wide and where the error is small the valve will be opened slightly.

Once the valve 33 is opened, fluid will flow between the first and second chambers at a rate controlled by the position of the valve 33. As the fluid flows between the two chambers the plunger 12 of the output solenoid will move simultaneously therewith. Therefore, the rate at which the output plunger 12 travels will be controlled by the position of the control valve 33 of the control solenoid 25.

As the output plunger 12 approaches its desired position, the position signal 54 will be added to the error signal as previously explained such that valve 33 will begin to close and the rate of flow between first and second chambers will lessen. As a result, the movement of the output plunger 12 will be slowed as it nears its desired position and overshoot of the desired position will be substantially prevented. When the output plunger 12 reaches the desired position, the error signal will be zero and the control solenoid 25 will close the valve 33 such that the output plunger 12 will again be locked in this equilibrium position. The output plunger 12 will remain locked in this position until the control solenoid 25 is again activated and the valve 33 is opened. In this system the output solenoid 3 is not affected by outside forces because the valve 33 locks it into its desired position. Therefore, the undesirable "softness" found in mechanically stabilized systems of the prior art is eliminated in the hydraulic control system of the invention.

When the control valve 33 locks the plunger 12 of the output solenoid 3 into its desired position, the power delivered to the coil 19 of the output solenoid 3 will be returned to its intermediate level. As a result, the governor of the invention typically uses less power than the electronic governors of the prior art because electronic governors rely on the continuous supply of electric power to maintain the plunger in position.

Because the "bang-bang" output solenoid 3 is controlled by the control solenoid 25, it can be turned on full or off rather than delaying for the integration build up necessary with prior art proportional valves. As a result, it has a greater range of effective operation and it is more efficient than known proportional actuators. The overall effect of the use of the hydraulic control of the invention results in an output that can be more tightly controlled than is the case with the prior art systems.

Figure 3:
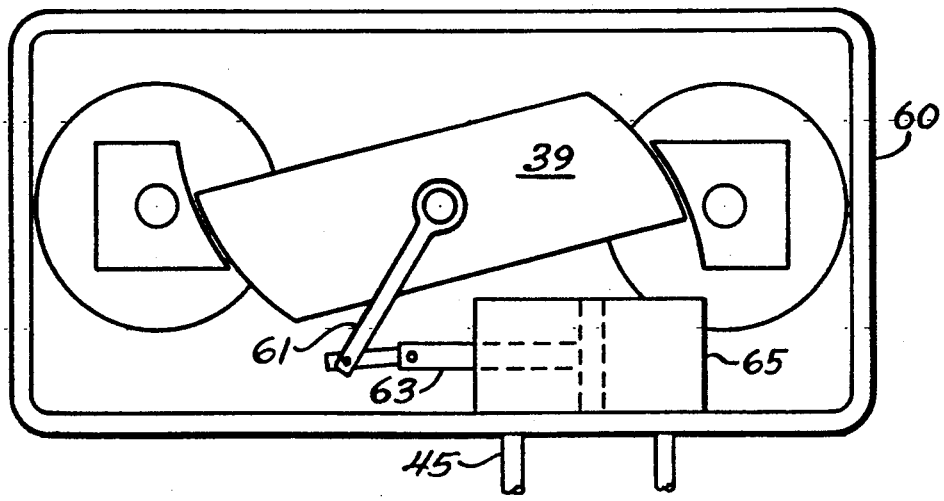
FIG. 3 shows a modification of the output solenoid in the preferred embodiment.

FIG. 3 shows a modification of the actuator 2 of FIG. 1. Specifically, the linear solenoids of the preferred embodiment can be replaced by rotary actuators 60. As shown, a linkage 61 connects rotary member 39 to a piston 63 of piston/cylinder 65. The chambers of the piston/cylinder 65 are connected to the control solenoid 25 by conduit 45. Thus, the piston/cylinder 65 assumes the function of the output solenoid 3 in the preferred embodiment and serves to lock the rotary member 39 in position. It should also be noted that a rotary actuator such as that shown in FIG. 3 could also be used to control movement of the control valve 33.

While the preferred embodiments of the invention have been described in some detail, it will be understood by one of ordinary skill of the art that changes and modifications can be made to the invention without the departing from the spirit and scope thereof and that the invention is intended to be limited in scope only by the appended claims.

What is claimed is:

1. An electro-hydraulic governor for controlling operation of on external device comprising;

(a) an electronically operated actuator having a movable member where the position of the member controls said external device, said electronically operated actuator being located in a hydraulic circuit;

(b) a control valve connected in the hydraulic circuit with said actuator for controlling the rate of movement of said member, and for locking it against movement when correctly positioned;

(c) control means for comparing actual condition against desired condition and for controlling the movement of said control valve to regulate the movement of member.

2. The governor according to claim 1, further including means for positioning said control valve such that the flow rate of fluid through said circuit can be controlled.

3. The governor according to claim 1, wherein said control means is electronic.

4. The governor according to claim 1, wherein the control means includes a proportional solenoid actuator.

5. The governor according to claim 1, wherein said control means includes means for producing a signal proportional to the difference between the desired and actual conditions.

6. The governor according to claim 1, further including means for producing a signal indicating the position of the plunger and for delivering said signal to said control means.

7. The governor according to claim 1, wherein the actuator comprises an output solenoid that is delivered full power by said means for controlling to move the member in a first direction and is delivered no power to move the member in a second direction.

8. The governor according to claim 7, wherein the output solenoid is maintained at an intermediate power level when the movable member is correctly positioned.

9. The governor according to claim 7, wherein the control means include means for generating a signal for delivering full power or no power to the output solenoid irrespective of the magnitude of the difference between the desired position and actual condition.

10. The governor according to claim 7, wherein the control valve is moved in proportion to the difference between the desired and actual conditions.

11. A governor for controlling operation of an external device comprising:

(a) an output solenoid having a movable plunger defining a first hydraulic chamber on one side of the plunger and a second hydraulic chamber on the opposite side of the plunger where the first and second chambers are isolated from one another, the position of said plunger controlling the external device;

(b) a conduit connecting the first hydraulic chamber to said second hydraulic chamber such that said plunger is free to move only when hydraulic fluid is free to move, through said conduit between said first and second chambers;

(c) a movable control valve located in said conduit for regulating the flow of hydraulic fluid through said conduit and between said first and second chambers;

(d) a control solenoid for moving said control valve; and (e) means for controlling said output solenoid and said control solenoid.

12. The governor according to claim 11, wherein said control means includes a means for comparing a desired condition of the external device to an actual condition of said external device and for producing a signal in response thereto proportional to the difference between the desired and actual conditions.

13. The governor according to claim 12, wherein said control means includes a means for turning the control solenoid on in proportion to the magnitude of the difference between the desired position and actual condition such that the control valve moves in proportion to said difference.

14. The governor according to claim 12, wherein said control means includes a means for turning the output solenoid on full or off irrespective of the magnitude of the difference between said desired position and said actual conditions.

15. The governor according to claim 14, wherein said first and second actuators are solenoids.

16. A governor for controlling operation of an external device comprising:

(a) a electronically operated first actuator having a movable member the position of which controls said external device;

(b) a control valve movable by a second actuator connected in a hydraulic circuit with said actuator for controlling the rate of movement of said plunger and for locking it against movement; and (c) means for controlling the movement of said control valve to regulate the movement of the member including: means for generating a first signal proportional to the difference between the desired condition of the external device and the actual condition of the external device, means for generating a second signal in response to said first signal, said second signal turning said first actuator on full, and means for generating a third signal in response to said first signal for turning on the second actuator in proportion to the size of the first signal whereby movement of said member is controlled by the position of said control valve.

17. The governor according to claim 16, wherein said first actuator includes a housing in which a first hydraulic chamber is on one side of the plunger and a second hydraulic chamber is on the other side of the plunger, said chambers being in said hydraulic circuit whereby said plunger is free to move only when fluid can flow between said first and second chamber.

18. The governor according to claim 17, wherein said control valve is located in said hydraulic circuit between said first and second chambers.

* * * * *